United States Patent [19]

Biebuyck

[11] 4,008,552

[45] Feb. 22, 1977

[54] WALL STRUCTURE AND ELEMENTS THEREFOR

[75] Inventor: Lawrence F. Biebuyck, Dallas, Tex.

[73] Assignee: Howmet Corporation, New York, N.Y.

[22] Filed: Mar. 21, 1975

[21] Appl. No.: 560,820

Related U.S. Application Data

[63] Continuation of Ser. No. 378,321, July 11, 1973, abandoned.

[52] U.S. Cl. ..... 52/397; 52/403; 52/665

[51] Int. Cl.[2] ..... E04B 1/62; E04C 2/38

[58] Field of Search ..... 52/397, 398, 399, 498, 52/499, 475, 476, 206, 403, 758 F, 758 H, 758 A, 656, 665; 49/504, 404, DIG. 1

[56] References Cited

UNITED STATES PATENTS

| | | | |
|---|---|---|---|
| 2,963,126 | 12/1960 | Cudini | 52/400 |
| 3,081,849 | 3/1963 | Hubbard | 52/397 |
| 3,093,217 | 6/1963 | Doede | 52/235 |
| 3,111,726 | 11/1963 | Grossman | 52/207 |
| 3,155,205 | 11/1964 | Place | 52/397 |
| 3,189,140 | 6/1965 | Luss | 52/400 |
| 3,266,207 | 8/1966 | Birum | 52/235 |
| 3,363,383 | 1/1968 | La Barge | 52/471 |
| 3,381,434 | 5/1968 | Carson | 52/397 |
| 3,527,011 | 9/1970 | Bloom | 52/399 |
| 3,805,470 | 4/1974 | Brown | 52/397 |

FOREIGN PATENTS OR APPLICATIONS

| | | | |
|---|---|---|---|
| 1,454,762 | 8/1966 | France | 49/DIG. 1 |
| 595,528 | 8/1958 | Italy | 52/235 |
| 353,877 | 6/1961 | Switzerland | 52/397 |

*Primary Examiner*—John E. Murtagh
*Attorney, Agent, or Firm*—Joseph H. Schley; Thomas L. Cantrell

[57] ABSTRACT

A wall structure having a framework, for supporting a plurality of panels in horizontal and vertical alignment, the wall structure being installable in an opening of a building structure to close such opening with the panels being installable in the framework either from the exterior or the interior of the building structure. A wall structure may also be installed on the exterior of a building structure as a curtain wall. Frame members are made up of interior and exterior box-like sections, which are connected together by insulating clips, working in connecting flanges on the sections, thus providing thermal isolation of the parts. The panels are gripped by gasketed flanges on the sections. Specific proportioning of the connecting flanges and gasketed flanges provides a metal free zone facilitating deglazing and providing room for internal water diverters.

5 Claims, 9 Drawing Figures

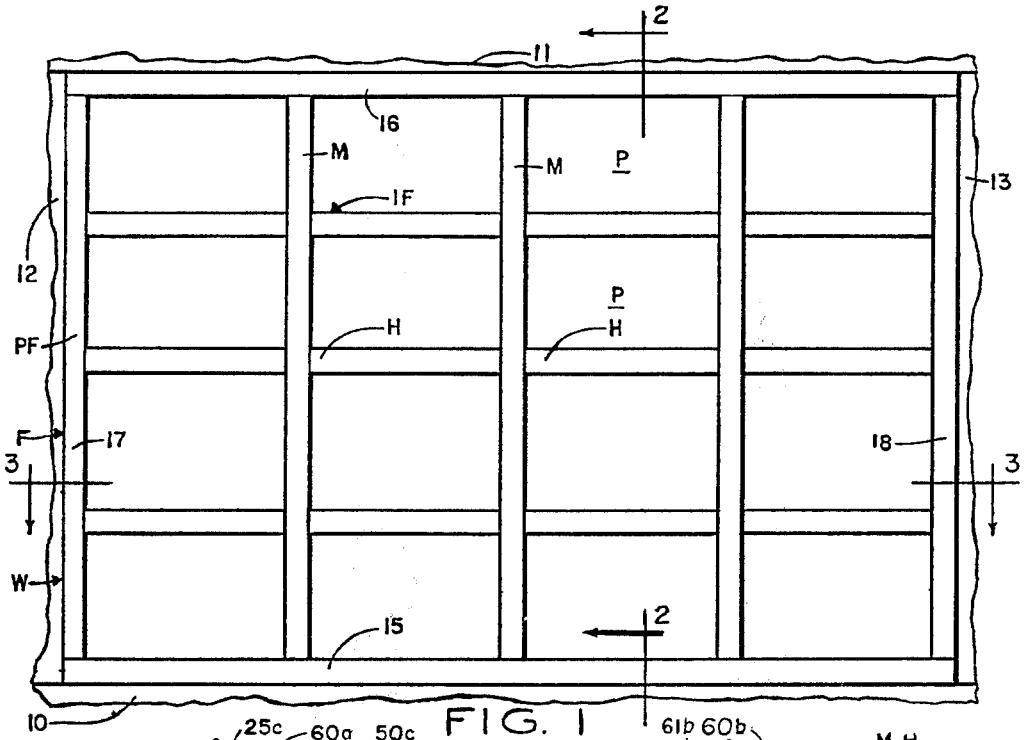
FIG. 1
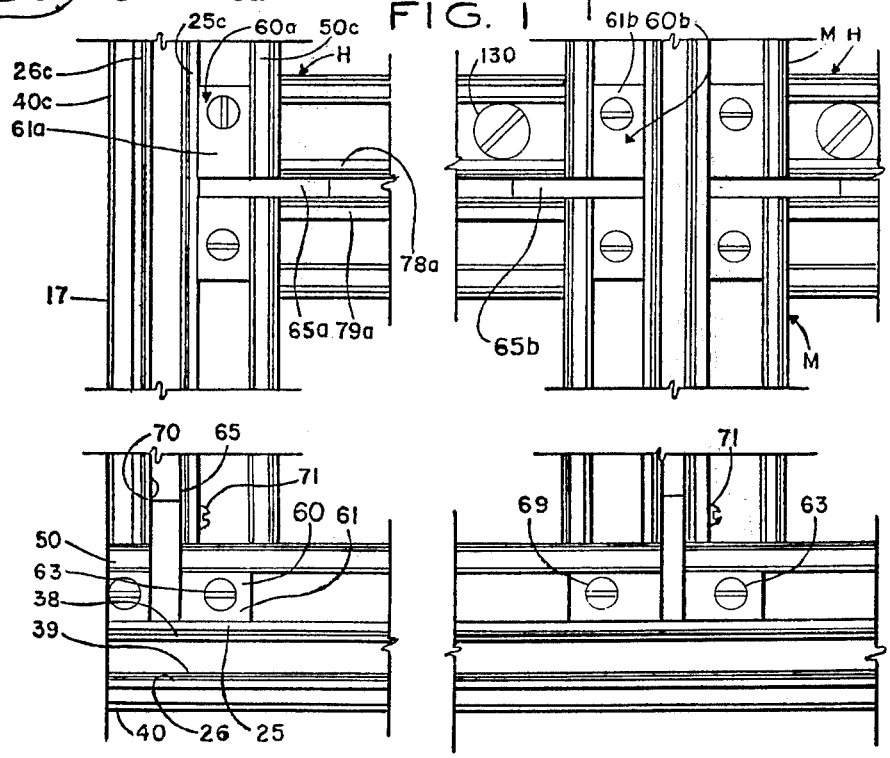

WALL STRUCTURE AND ELEMENTS THEREFOR

This is a continuation of application Ser. No. 378,321, filed on July 11, 1973, now abandoned.

BACKGROUND OF THE INVENTION

This invention relates to wall structures and to structural elements usable in the wall structure.

Frame-and-panel wall systems have been used for some time, both for filling and closing openings in building walls ("store front" applications) and for enclosing building structural frames ("curtain wall" applications). Modern systems typically employ extruded aluminum shapes for the frame members, and glass, plastic or metal panels. The shapes employed to form the frame members, whether single piece or multipiece, are often made quite complex in an effort to meet all of the installation and functional requirements of an effective frame member. Such requirements include adequate structural strength for the static and dynamic loads to be encountered, weather-tight gripping of the panels, water-tightness, ease of erection of the frame and installation of the panels therein (or at least a basic feasibility of such operations), ease of reglazing, and adaptability to widely varying installation situtations. One desirable feature of wall frame members employed in cold climates is that of thermal insulation, but this feature has been difficult to provide in view of the excellent thermal conductivity of aluminum.

The increasing complexity of the frame-forming shapes in panel wall systems has led to a multiplication in the number of pieces involved in a given system, including, for example, different pieces which have the same basic structure, but are "right-handed" or "left-handed" to fit in particular sections of an installation. The increased number of parts complicates manufacturing operations, warehousing at all distribution levels, ordering, job planning and layout, and the installation work itself.

SUMMARY OF THE INVENTION

In accordance with the present invention, there is provided a wall system in which only four primary shapes are involved for forming the framing system — two for the internal frames, whether vertical or horizontal, and two for the perimeter frames, whether vertical or horizontal. The pairs of shapes which form a single frame member are attached together at the job site after installation of the panels, thus simplifying the glazing operation, and the attachment is by means of novel internal plastic clip devices which thermally isolate the interior and exterior portions of the frame member from each other and at the same time eliminate externally appearing fasteners and joint lines. The pairs of shapes may be oriented with respect to the building at the job site to provide a frame glazed from the interior of the building, or one glazed from the exterior. Water diverters are provided between the shapes in horizontal frame members to prevent infiltration of water through the wall.

While all of the aspects of the invention are explained in detail below in connection with the description of the preferred embodiment, it can be pointed out here that a typical frame member constructed in accordance with the invention includes two elongate members, a mullion gutter and a mullion face, both of which are generally box-like in cross-section. They are designed to be connected together along facing sides, and when so connected, to grip or sandwich between them the edges of two panels, one above and one below the frame member (or one to one side and one to the other side, in the case of a vertical frame member). To this end, the mullion face and mullion gutter are each provided with gasket flanges which run along the corners of their facing sides, and on which are mounted specially configured vinyl glazing gaskets for engaging the panels along their edges.

The facing sides of the mullion face and mullion gutter are also provided with pairs of flanges running along the middles thereof, which pairs of flanges form two facing connecting grooves or recesses, both of which are equipped with detent lock means. The mullion gutter and mullion face are connected together with specially configured plastic clips at spaced intervals along their length. One end of a clip is detent-locked in the connecting groove of the mullion gutter, and the other end of the clip is detent-locked in the connecting groove of the mullion face. The clips and flanges forming the connecting grooves are so proportioned with respect to the gasket flanges that when the two parts are united by the clips, the gasket flanges and gaskets are brought into the panel-gripping position.

From the foregoing, it can be seen that there is no metal-to-metal contact between the two parts making up the completed frame member. Heat flowing from one part to the other must pass through either the spaced plastic clips, the panel gripping vinyl gaskets, or the internal dead air spaced formed by the gasket flanges, all of which are poor conductors. There is thus obtained effective thermal isolation between the two parts which alleviates, in large measure, condensation problems and excessive through-wall heat-loss in cold climates.

The flanges forming the connecting groove on the mullion gutter project from its side a greater distance than do the corresponding flanges on the mullion face. Thus, the gutter flanges extend into the plane occupied by the panels when installed, and serve as support means for a panel positioned above a horizontal frame members. But the projection distance of the gutter flanges and the length of the connecting clips are such that when the gutter and face are united by the clips, the gutter flanges do not extend into the plane of the glazing gasket flanges of the mullion face.

The arrangement and proportioning just described have several important consequences which produce advantages unique to the invention. They produce a zone extending all the way across the assembled frame member in which there is no metal. At the outer edges of the zone are the vinyl glazing gaskets. The interior of the zone is largely dead air space, but a portion of it is occupied by the mid-sections of the spaced plastic connecting clips.

One advantage of the metal-free zone is that it makes deglazing and reglazing quite simple. All that need be done is to pry out one of the glazing gaskets, insert a cutting tool such as a keyhole saw, slide the tool along the frame member until a clip is encountered, cut the clip in two, and repeat the sliding and cutting steps until all clips have been severed. The mullion face can then be removed, followed by the broken panel. New clips are used to replace the mullion face after a new panel has been put into position.

A consequent advantage resulting from the metal-free zone and the simple clip-cutting deglazing procedure it makes possible is the elimination of the necessity for the detachable or reusable clip means. The thorny design problem of providing a clip or other attachment device which will reliably hold the parts together under all the stresses and loadings of wall use, and yet readily permit their separation for deglazing, is completely avoided.

Another advantage of the metal-free zone is that it provides a convenient vertical path in which the vertical portion of an internal water diverter can be positioned in a horizontal frame member. In accordance with an important aspect of the invention, internal water diverters are employed to insure that the water intruding into the interior of a frame member does not penetrate through the wall into the building interior. As is explained below, the diverter is shaped to extend from a point behind (toward the building interior) the bottom edge of a panel located above the frame member, to a point in front of the top edge of a panel located below the frame member. The metal-free zone provides a space for the downward run of the diverter.

Finally, it should be noted that the proportioning of the mullion gutter flanges so that they do not protrude into the plane of the metal portions of the mullion face makes it unnecessary to form complex mitered joints at the junctions of horizontal and vertical members. Simple butt joints may be used instead.

The perimeter frame elements are formed of pairs of shapes basically similar to those employed to form the internal horizontal and vertical frame members, but with provision to grip a panel along only one side, instead of two, and means are provided for attaching the perimeter pieces to the edges of the building wall opening.

There are advantages and disadvantages to both internal and external glazing arrangements of frame-and-panel wall systems. In accordance with the invention, the wall system may be installed in either manner in accordance with the local balance of advantages in the view of the architect involved. When internal glazing is desired, the mullion gutter is oriented toward the exterior of the building and when exterior glazing is desired, the mullion gutter is oriented toward the interior of the building. The only parts which must be varied in shape between the two types of installations are the water diverters, as is explained below.

From the foregoing it can be seen that it is desirable that the number of different structural elements of a wall structure be as small as possible and still permit installation of the wall structure in an opening of the building structure either from the exterior or the interior of the building. It is also desirable to provide a wall structure whose prefabricated elements may be installed on the exterior of a building structure to form a curtain wall therefore.

Accordingly, it is an object of this invention to provide a new and improved wall structure which is erected from prefabricated structural members.

It is another object to provide a wall structure whose elements permit installation of the wall structure on a building structure in several different manners without requiring alteration in the design or form of such elements.

Still another object is to provide a wall structure having a framework erectable from prefabricated structural elements on a building structure in such manner as to permit installation of the wall panels of the wall structure from either the exterior or the interior of the building structure.

A further object is to provide a wall structure wherein the horizontal members of the framework are provided with water diverters which direct water which may accumulate between spaced horizontal edges of vertically adjacent panels of the wall structure to the exterior of the top edge portion of the lower panel.

A further object is to provide a wall structure having a framework providing a plurality of vertically aligned rectangular openings closable by rectangular panels.

A still further object is to provide a wall structure of the type described, wherein the wall framework includes vertical and horizontal frame members rigidly securable to a building structure and face members lockable to the frame members for holding peripheral portions of the panels therebetween.

Another object is to provide a wall structure, of the type described, wherein the frame members are provided with laterally extending longitudinal means which provide stop or support surfaces for an adjacent edge of a wall panel and a lock means to which connector clips, for securing the face members to the frame members, are lockable.

Still another object is to provide a wall structure, of the type described, wherein each face and frame member is provided with at least one gasket lock flange on which a gasket is mountable for engaging a panel and holding it against displacement when the face members are connected to the frame members by the connector clips.

Still another object is to provide a wall structure, of the type described, wherein the gasket lock flanges of the frame members extend a shorter distance from the frame members than the stop and support means thereof whereby access to the connector clips is provided between a surface of a panel and a face member connected to a frame member to permit insertion of a tool to cut the connector member when it is necessary to remove a face member or a panel.

Still another object is to provide a wall structure of the type described wherein the gaskets, the water diverters and the connector clips are of a substance having a low coefficient of heat conductivity so that the face and frame members do not directly engage each other or the panels whereby transmission of heat through the wall structure is minimized.

An important object of the invention is to provide a cooperable pair of wall structural members for receiving and holding a peripheral portion of a wall panel therebetween with a predetermined force and limiting its movement in vertical and horizontal directions.

Another object is to provide a cooperable pair of structural members, of the type described, each having a longitudinal body and lock recess flange means extending from the edges toward each other, and a connector clip having opposite end portions lockable to the lock recess flange means of the two members for connecting the two members in aligned spaced relation to one another.

Still another object is to provide a cooperable pair of structural members, wherein each of the members has a gasket lock flange extending parallel to and spaced from its lock recess flange means, and wherein the lock recess flange means of one of the members extends outwardly therefrom a greater distance than its gasket lock flange whereby such lock recess flange means is adapted to support or limit movement of an adjacent panel relative to the pair of structural members.

An important object is to provide a new and improved connector clip for locking two wall structural elements to one another which minimizes flow of heat therebetween and which facilitates connection of one member to the other.

Another important object is to provide a new and improved gasket mountable on a wall structural member which is compressible against a wall panel, the force of whose connection to the member increases as the force with which it is compressed against the panel is increased.

Other objects and advantages of the invention will become apparent upon reading the following description of a wall structure embodying the invention together with the accompanying drawings:

DESCRIPTION OF THE DRAWINGS

FIG. 1 is an elevational view of a wall structure embodying the invention showing an installation wherein the panels are installed from the exterior;

FIG. 4 is a fragmentary elevational view, with some elements removed, of the wall structure;

DESCRIPTION OF THE PREFERRED EMBODIMENTS

Figure 2:
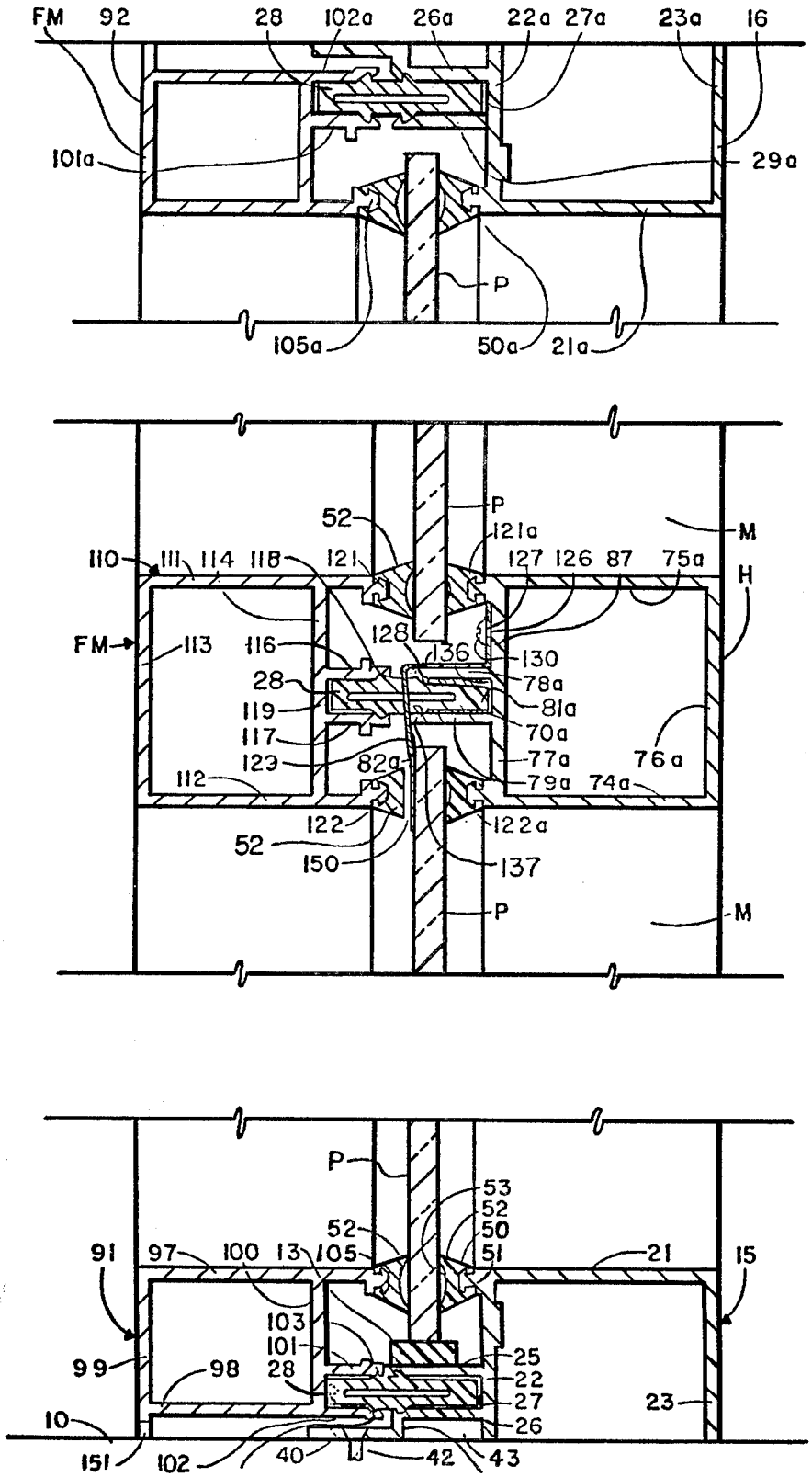
FIG. 2 is a vertical sectional view of the wall structure illustrated in FIG. 1, the section being taken on the line 2—2 of FIG. 1.

Referring now to the drawings, and particularly FIG. 1, the wall structure W is installable in an opening of a building structure which is defined by a bottom sill member 10, a head member 11, and vertical side members 12 and 13. The wall structure W includes a frame work F comprising a perimeter frame PF; and inner frame IF including vertical mullions M and horizontals H; panels P; and face members FM (see FIG. 2) which are connected to the various members of the frame work F.

Figure 2A:
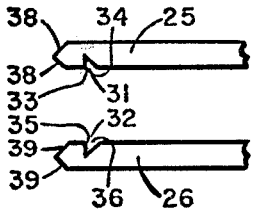
FIG. 2A is a fragmentary enlarged view of a flange element of the wall structure.

The frame PF includes a sill member 15, a head member 16 and vertical jamb members 17 and 18. The sill member 15 extends the full width of the building opening and its opposite ends abut the inside surfaces of the perimeter frame members 12 and 13. As is shown in FIG. 2, the sill member 15 includes a top wall 21 from which depend vertical flanges 22 and 23 which rest upon the sill member 10. A pair of horizontal flanges 25 and 26 extend outwardly from the wall 22 to define a longitudinal lock recess 27 in which are receivable connector clips 28 as will be explained in greater detail below. The details of these flanges are shown in FIG. 2A. Adjacent their outer ends the horizontal flanges 25 and 26 are provided with longitudinally extending lock grooves 31 and 32. The lock groove 31 has its outer end defined by a longitudinal shoulder surface 33 which extends substantially perpendicularly to the horizontal and a longitudinal surface 34 which extends downwardly and inwardly. Similarly, the lock groove 32 is defined by a shoulder 35 which extends perpendicularly to the horizontal and an upwardly and inwardly extending surface 36. The ends of the flanges 25 and 26 are provided with convergently, inwardly extending cam surfaces 38 and 39.

A foot flange 40, whose bottom surface is adapted to rest on the sill member 10, is connected to the outer end of the bottom horizontal flange 26 by a vertical portion 41, (see FIG. 2). The foot flange is securable to the sill member in any suitable manner, as by a plurality of spaced screws 42 which extend through suitable apertures of the foot flange into the sill member.

The portion 41, the bottom horizontal flange 26 and the bottom portion of the vertical flange 22 define a downwardly opening recess 43 in which is receivable a suitable sealing substance such as a commercially available product sold under the trade name "MASTIC".

The sill member 15 also has a horizontal gasket lock flange 50 which is receivable in a lock slot 51 of a resilient gasket 52. The gasket may be fitted onto the gasket lock flange 50 by deforming the gasket and it will thereafter remain in place. The front surface 53 of the gasket is curved and as the gasket is compressed provides a hermetic seal between the sill member 15 and the panel P which it engages.

The perimeter frame members 16, (FIG. 2) 17 and 19 (FIG. 3) are identical in structure to the perimeter frame member 15 and, accordingly, their elements have been provided with the same reference numerals to which the subscripts *a*, *b*, and *c*, respectively, have been added as the corresponding elements of the bottom perimeter frame member 15.

The vertical perimeter frame members 17 and 18 and the vertical mullions of the inner frame extend between perimeter frame members 15 and 16 and may be secured thereto in any suitable manner as by conventional shear blocks or, as seen in FIG. 4, by substantially T-shaped joint clips 60. (Since the perimeter members 15, 16, 17 and 18 are all attached to the building wall, their attachment to one another may be omitted if desired). Each T-shaped joint clip 60 has a flat head portion 61 and a leg portion in the form of an upstanding rib 65. Both the head 61 and the rib 65 are apertured to accommodate screws. Rib 65 is notched to fit over a gasket lock flange 50 when the head 61 is abutted against the vertical surface of a first mullion, and the remainder of rib 65 extends into the longitudinal lock recess 70 of a second mullion oriented perpendicularly to the first mullion by screws 63; rib portion 65 is secured to the second mullion by screws 71.

Figure 3:
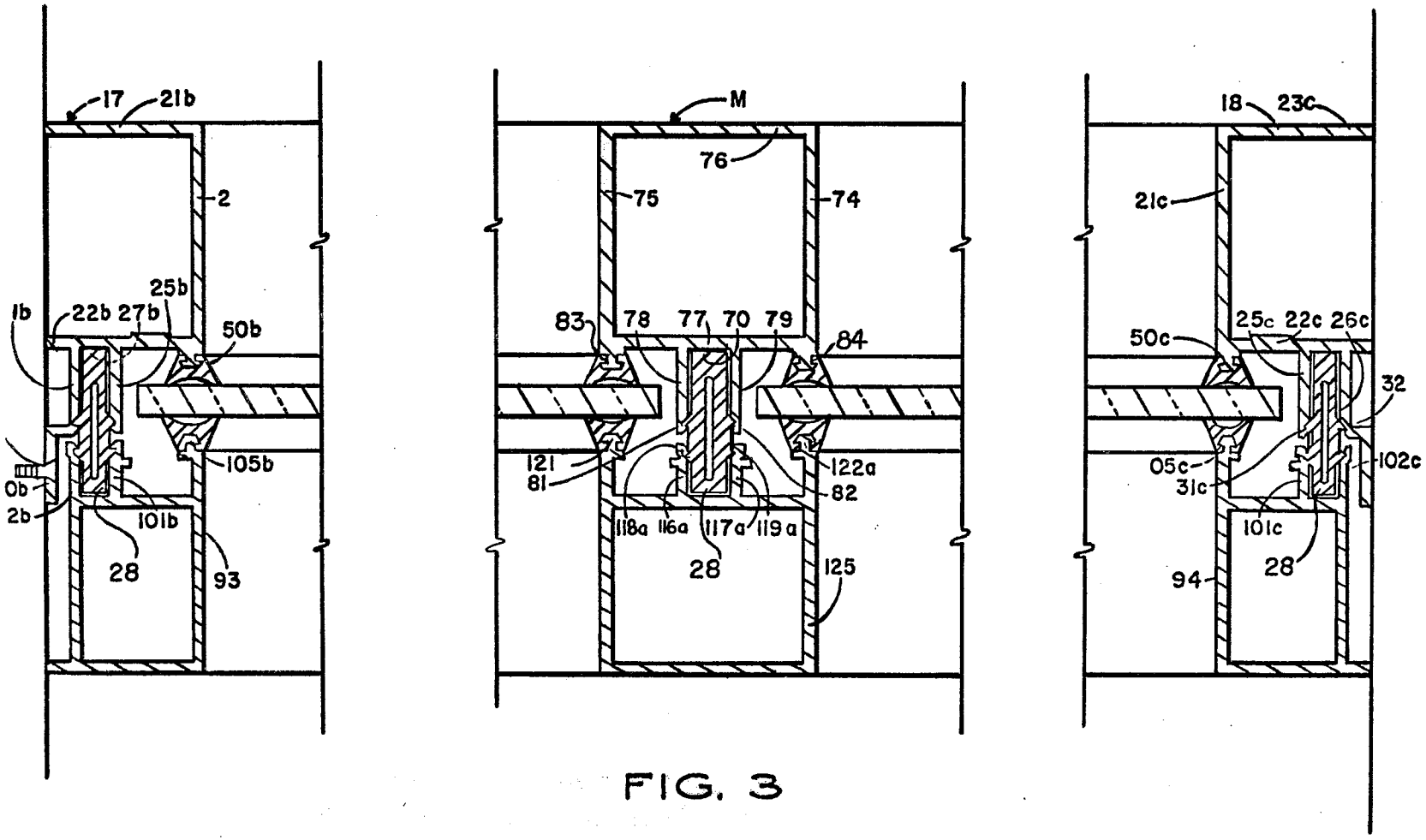
FIG. 3 is a horizontal sectional view of the wall structure of FIG. 1, the section being taken on the line 3—3 of FIG. 1.

As can be seen from FIG. 3, each of the vertical mullions M is of substantially rectangular cross-sectional configuration having side walls 74 and 75 and end walls 76 and 77. The lock recess 70 of each mullion is defined by a pair of parallel lock flanges 78 and 79 which extend outwardly from the outer wall 77 and are provided adjacent their outer ends with lock grooves 81 and 82. Gasket lock flanges 83 and 84 extend forwardly from the outer wall 77 outwardly of the lock flanges 78 and 79, respectively.

The horizontals H shown best in FIG. 2 are identical in configuration to the mullions M and, accordingly, their elements have been provided with the same reference numerals, to which the subscript *a* has been added, as the corresponding elements of the mullions. (Compare FIGS. 2 and 3).

The horizontals H are connected at their opposite ends to adjacent peripheral frame members and mullions by joint clips, such as the joint clips 60*a*, FIG. 4. One end of each horizontal H is secured to, for example, the perimeter frame member 17 by a joint clip 60*a* whose head 61*a* is secured to the member 17 and whose rib 65*b* extends between the flanges 78*a* and 79*a* of the horizontal. The other end of the horizontal is similarly secured to next inner mullion by another joint clip such as the joint clip 60*b* whose head portion 61*b* is secured to such mullion and whose rib extends between the flanges 78*a* and 79*a* at the other end of the horizontal.

The outer edge portions of the panels P which are held by the perimeter frame are secured thereto by bottom and top face members 91 and 92 (FIG. 2) and vertical face members 93 and 94 (FIG. 3) and connector clips 28 which lock the face members to these frame members.

As can be seen from FIG. 2, the perimeter face member 91 has top and bottom horizontal walls 97 and 98 and vertical walls 99 and 100. The lower portion of the vertical wall 99 extends downwardly of the lower horizontal wall 98 and is adapted to engage the top surface of the sill member 10. A pair of horizontal clip flanges 101 and 102 extend forwardly from the inner wall 100 and are provided at their ends with internal lock recesses 103 and 104, respectively.

The inner end of the top horizontal wall 97 is provided with a gasket lock flange 105 to which is securable a gasket 52.

The perimeter face members 92 (FIG. 2), 93 and 94 (FIG. 3) are identical in configuration to the bottom face member 91 and, accordingly, their elements have been provided with the same reference numbers, to which the subscripts *a*, *b* and *c* have been added, as the corresponding elements of the perimeter face member 91.

As can be seen in FIG. 2, the horizontal face members 110 are securable to the horizontals and each has horizontal top and bottom walls 111 and 112, and outer and inner side walls 113 and 114. The inner side wall 114 has a pair of clip lock flanges 116 and 117 provided at their ends with lock recesses 118 and 119, respectively, and a pair of gasket lock flanges 121 and 122 disposed inwardly of the inner wall 114 and spaced from the lock flanges 116 and 117, respectively.

The face members 125 (FIG. 3) which are connectible to the vertical mullions are identical in configuration to the horizontal face member 110 and accordingly, their elements have been provided with the same reference numerals, to which the subscript *a* has been added, as the corresponding elements of the horizontal face member 110.

A water diverter 126, which is shown best in FIG. 2, is connected to each of the horizontals to divert water to the exterior of the wall structure. Each water diverter has a top vertical portion 127 which is adapted to abut the surface 87 of the vertical wall 77*a* of the horizontal above its top lock flange 78*a*, a horizontal portion 128 which extends over the top surface of the lock flange 78*a* and a bottom vertical portion 129 which is adapted to overlap the top edge portion of a panel P located below the lower clip lock flange 79*a*. The diverter may be rigidly secured to the inner wall 77*a* by longitudinal spaced screws 130 if desired, but such attachment may be omitted.

Figure 5:
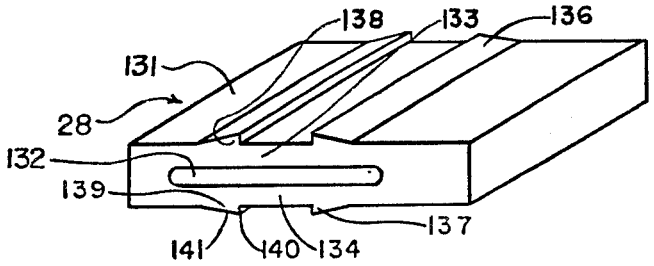
FIG. 5 is a perspective view of a connector clip of the wall structure.

Attention is now directed to FIG. 5, which shows that each of the clips 28 is formed of a somewhat resilient plastic substance and has a rectangular body 131 provided with an elongate longitudinal slot 132 which permits deformation of the portions 133 and 134 of the body one another as the clip is inserted into a lock recess of a face or frame member.

Lock flanges 136, 137, 138 and 139 extend from the sides of the body and each has a shoulder 140 which extends peripendicularly from the body and an inclined cam shoulder 141. The cam shoulders 141 are adapted to engage the cam shoulders of the lock flanges, such as the cam shoulders 38 and 39 (FIG. 2*a*) of the bottom frame member 15, as the clip is inserted into its lock recess 27 to cause inward flexing of the body portions 133 and 134 as the opposed pair of lock flanges 136 and 137 moves therepast and into the lock recess 34 and 35, respectively. The clip is then locked in place due to the engagement of the shoulders 141 of the flanges 136 and 137 with the shoulders 33 and 35 of the member 15.

If the panels are to be installed from the exterior of the building, the perimeter frame is secured a predetermined distance from the exterior of the building structure as illustrated in FIGS. 2 and 3 so that the lock flanges 25 and 26 of the frame members 15, 16, 17 and 18 extend outwardly toward the exterior of the building (toward the left of FIG. 2; toward the bottom of FIG. 3). A sealant is of course applied at the time of installation of the perimeter frame members 15, 16, 17 and 18 to seal between the perimeter frame members and the building structure members 10, 11, 12 and 13.

A suitable sealant is also applied at all locations of abutment of the bottom and top frame members 15 and 16 with the side perimeter frame members 17 and 18. The vertical mullions are next installed between and connected to the top and bottom perimeter frame members 16 and 15. The horizontals H are next connected to the vertical perimeter frame members and the vertical mullions by means of the joint clips. At the locations of the connections of the various members to one another a sealant is applied. Gaskets 53 are then mounted on the various gasket lock flanges of the member 15, the mullions and the vertical frame members 17 and 18 and connector clips are inserted at spaced locations in each vertical mullion and the frame members 17 and 18. The panels P are then placed in position on the usual setting blocks 13 which rest on the horizontal flange 25 of the member 15.

The panels P are thus supported on the top flange 25 of the member 15 and may be then held in place temporarily by any suitable means.

Water diverters 126 are then installed on the horizontals, by driving the connectors 28 through appropriate spaced apertures in their vertical portions 129 and into lock recesses 70*a* of the horizontals with their lock flanges 136 and 137 moving into the lock recesses 81*a* and 82*a* of the flanges 78*a* and 79*a*. A sealant is then employed to seal between the connector clips and the water diverter.

The face members for the member 15, the mullions and the horizontals are provided with gaskets 52 and are then installed on such members by means of the connector clips whose outer ends now extend outwardly of the water diverters and from the lock recesses of the mullions and the perimeter frame members 17 and 18.

A consideration of FIG. 2 will reveal that any water which may seep downwardly between the panels and each upper horizontal gaskets 52, or which may condense between the face members and frame members because of atmospheric pressure and temperature changes is directed outwardly by the water diverters and over the upper edge of the next lower panel. The lower outside gaskets, such as the gasket 52 of a face member 110 are provided with spaced passages, as at 150, to permit such water to flow to the exterior. (See FIG. 2). The bottom face member 91 may also have passages 151 for this purpose.

The connector clips 28 now lock the face members to the members to which they are connected. If it thereafter becomes desirable to remove a face member, one of the gaskets of the face member is first removed, a saw is inserted from the exterior into the space between the facing ends of the lock flanges of the face member and the lock flanges of the frame member on which it is mounted, and the connector clips are sawed through. New connector clips are then used when the face member is replaced.

Figure 5A:
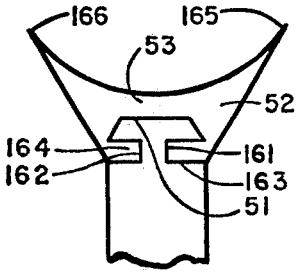
FIG. 5A is a fragmentary end view of a gasket and gasket lock flange constructed in accordance with the invention.

Referring now to FIG. 5A, it can be seen that the configurations of the gaskets 52 and the gasket lock flanges 51 on which they are mounted are such that when installed and held in compression with a panel, the forces exerted on the gasket tend to hold it securely on the gasket lock flanges. Each lock flange has a pair of longitudinal grooves 161 and 162 in which are received the longitudinal flanges 163 and 164 of the gasket. The body of the gasket is of increasingly greater width from the flanges 163 and 164 so that as the gasket edges 165 and 166 engage a panel and are pressed back, the compressive forces thus generated tend to compress the flanges 163 and 164 into the grooves 161 and 162. Thus the greater the compressive load on the gasket, the greater is the force with which it is held on its associated gasket lock flange.

Figure 6:
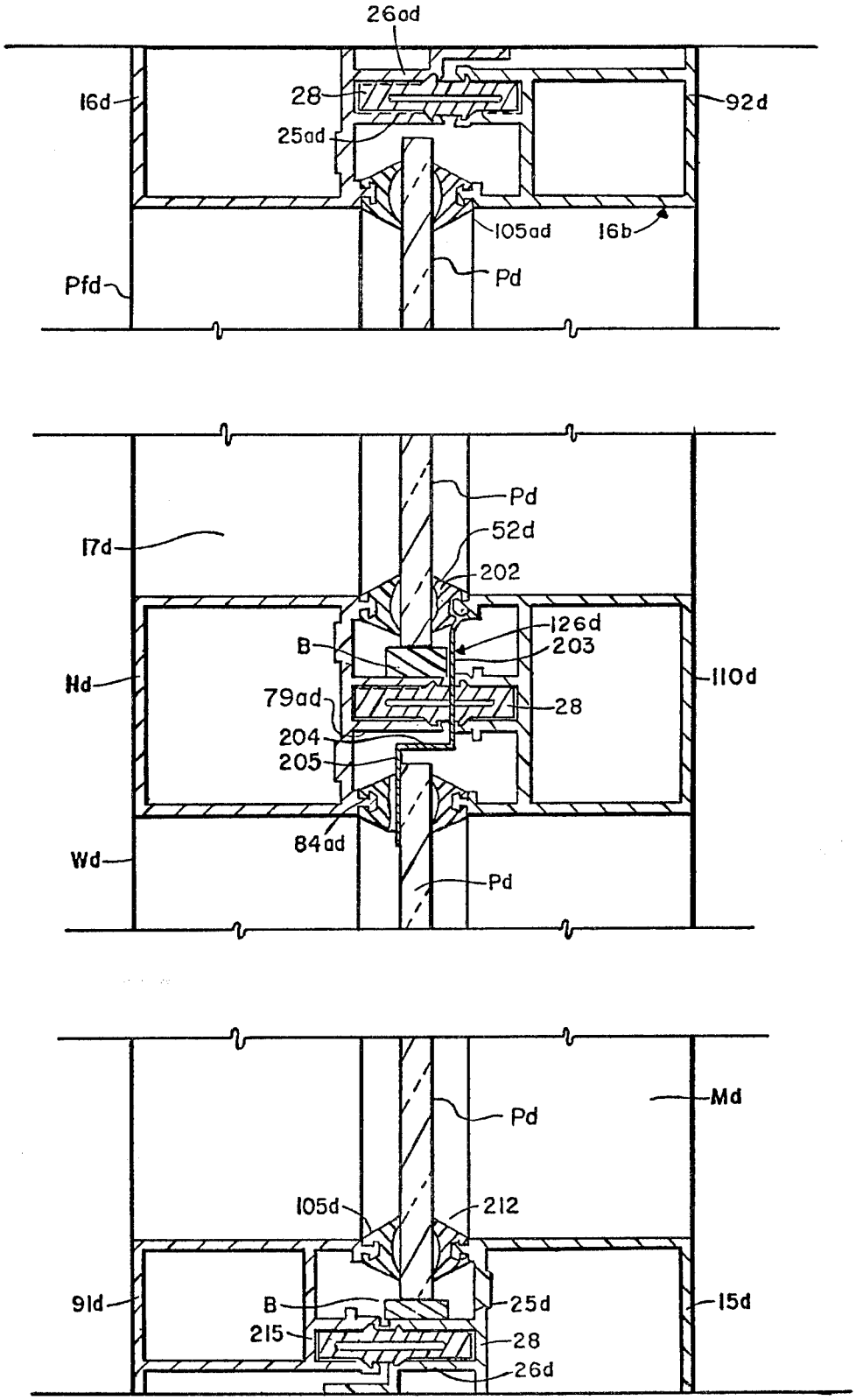
FIG. 6 is a vertical sectional view, similar to FIG. 2, of a wall structure showing an installation wherein the panels are installed from the interior.

Referring now particularly to FIG. 6 of the drawings, the face and frame members of the wall structure W*d* are identical to those of the wall structure W and, accordingly, their elements have been provided with the same reference numerals to which the subscript *d* has been added, as the correspondingly elements of the face and frame members of the wall structure W.

The wall structure W*d* differs from the wall structure W in that its panels are installed from the interior of the building structure rather than the exterior.

The positions of the head and vertical members 16*d* and the vertical members 17*d* and 18*d* are such that they are positioned outwardly of their face members so that their lock flanges, as, for example, the lock flanges 25*ad* and 26*ad* of the head member 16*d* extend inwardly relative to the building structure (inwardly being toward the right in FIG. 6). The bottom perimeter frame member 15*d*, however, is positioned relative to the building structure so that its lock flanges 25*d* and 26*d* extend outwardly.

In the installation of the wall structure W*d*, the members 15 of the perimeter frame PF*d* are secured to the members of the building structure as illustrated in FIG. 6.

Connector clips 28 are then mounted on the bottom perimeter frame member 15*d*. The face member 91*d*, after a gasket 105*d* is positioned on its gasket lock flange, is then locked to the frame member 15*d* by means of the connector clips.

The top ends of the mullions M are then connected to the top perimeter frame member 16*d* by joint clips, such as the joint clips 60, or by the usual shear blocks. The bottom ends of the mullions are connected to the bottom frame member 15*d* by any suitable means.

The horizontals H*d* are next connected between the mullions and between the outermost mullions and the vertical perimeter frame members.

The panels P*d* of the top row of panels are then installed and held in place by any suitable temporary holding means.

The water diverters 126*d* are then prepared for installation on the horizontals H*d* immediately below the top perimeter frame member 16*d* by having mounted thereon connector clips and a gasket 52*d* on its top channel portion 202. Each diverter has a vertical portion 203 which extends from the channel portion 202 to below the bottom lock flange 79*ad* of the horizontals, a horizontal portion 204, and a bottom vertical portion 205 which extends below the lock flange 84*ad* of the horizontal. The gasket on flange 84*ad* is apertured at intervals to permit escape of water.

The next lower row or lite of panels is then mounted on the next lower horizontals, and the face members, such as the face member 110*d*, are connected to the topmost horizontals by moving them onto the connector clips after gaskets have been mounted on their bottom gasket lock flanges 84*d*.

The face members 110*d* then hold the bottom portions of the upper panels and the top portions of the lower panels. The panels may be installed in vertical rows from one side of the framework to the other and the face members of the vertical mullions may be secured to each mullion after the vertical rows of panels on each side thereof are in place.

The above sequence of operations is repeated during the sequence of installation of each progressively lower row of panels until the bottom row of panels is to be installed.

The panels of the bottom row are installed by inserting their lower portions while the panel is inclined inwardly and upwardly, into the upwardly open space between the gasket and the gasket lock flange 105*d* of the face member 91*d* and causing their bottom edges to rest on support blocks B positioned on the horizontal flange 25*d*. The panels are then pivoted upwardly and outwardly into vertical postions. Face members are then installed on the vertical mullions in sequence as each vertical row of panels is installed in sequence with the horizontal face members installed between them. Wedge gaskets 212 are then forced between the gasket lock flange and the panels of the bottom row.

During the installation of the wall structure W*d*, as in the installation of the wall structure W, a sealant is used to seal between the various elements of the framework and the water diverters at all locations where spaces might exist which open both to the exterior and the interior of the wall structure.

Figure 7:
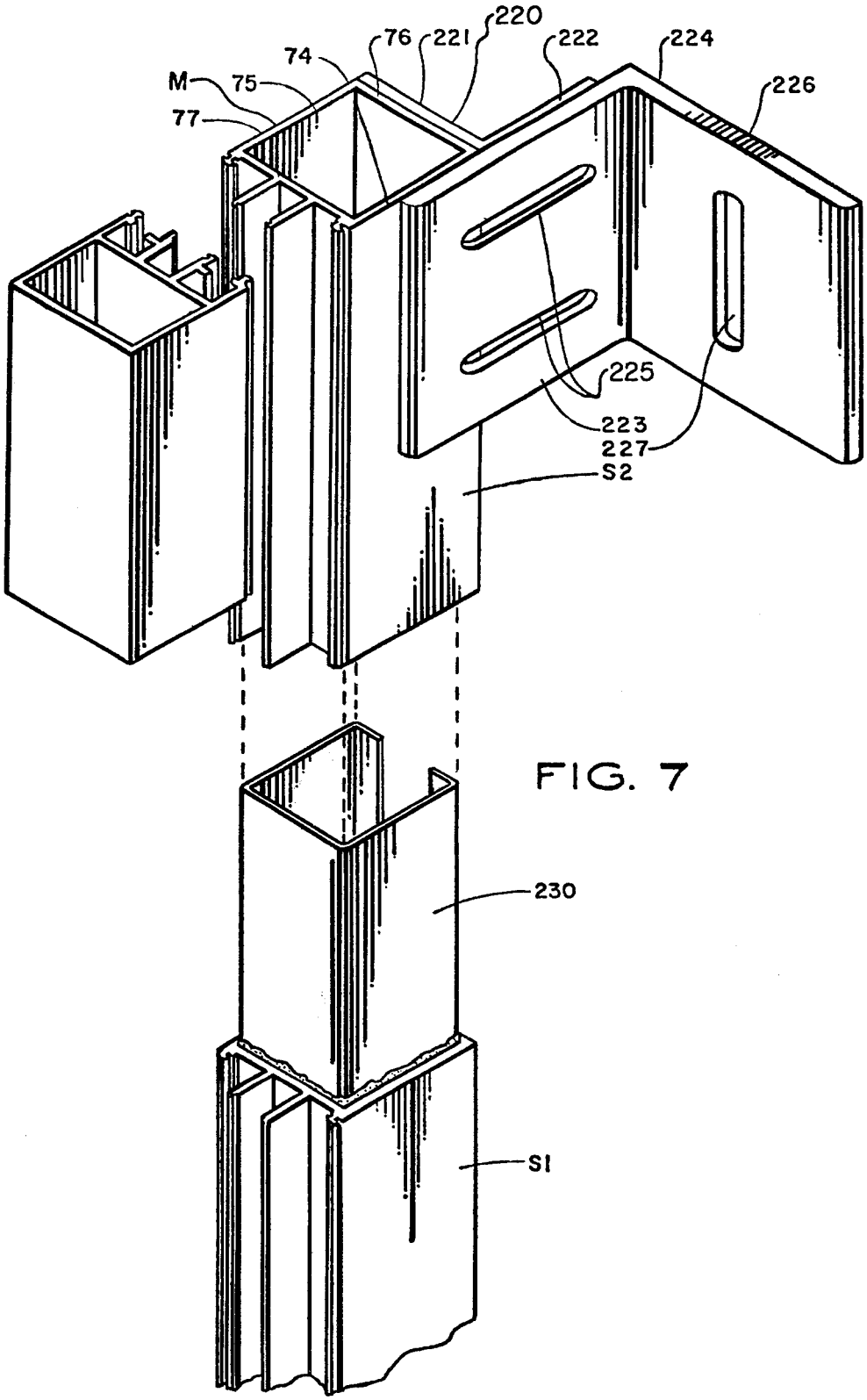
FIG. 7 is a perspective fragmentary view showing the manner in which the vertical mullions are connected to a building structure in installations where the wall structure embodying the invention is installed as a curtain wall.

FIG. 7 illustrates the manner in which the vertical mullions of the wall structure embodying the invention may be connected to fixed elements of a building structure when a curtain wall is to be installed thereon with the panels to be installed from the exterior.

Each mullion M is secured to a fixed building structure element by a plurality of vertically spaced angle members such as 220 whose arm 221 may be secured to the wall 76 of the mullion by welding or the like and whose arm 222 is secured to an arm 223 of a second vertical angle bracket 224 by bolts which extend through suitable apertures in the arm 222 with horizontal slots 225 in the bracket arm 223. The other arm 226 of bracket 224 is securable to a building-fixed element by bolts which extend through its vertical slot 227.

It will be apparent that the provision of the slots of the arms of the angle bracket permits lateral and horizontal adjustment of the position of the mullions.

Adjacent ends of adjacent mullion sections S1 and S2 are connected by a splice joint 230 whose lower end portion is telescoped in and rigidly secured in the top end portions of the lower section 51 and whose upper end portion is slidably telescoped in the bottom end portion of the upper section S2. The ends of the mullion sections are thus free to move vertically relative to one another to accommodate variations in the lengths thereof due to expansion and contraction thereof due to changes in temperature.

It will now be seen that a new and improved wall structure has been illustrated and described whose panels can be installed from either the exterior or the interior of the building structure using identical framework members so that only different water diverters, the diverter 126 for exterior installations and the diverter **126*d*** for interior installations, are required for these alternate installations.

It will also be seen that new and improved elements for wall structure have been provided which permits such alternate installations of the wall structure.

It will also be seen that the water diverters, such as the diverters 126 and **126*d***, each have a vertical portion which extends upwardly of the lower portion of one panel, a horizontal portion which extends outwardly between the bottom and top edges of the two vertically aligned panels, and a vertical portion which extends outwardly of and below the top edge of the lower panel, and that connector clips extend through one of the vertical portions of the diverter and below the bottom and top edges of the panels to connect face members to the horizontal frame members of the framework.

It will be apparent that the lengths of the connector clip between their pairs of lock flanges is such that intermediate portions of the clips, between the face members and the adjacent side surfaces of the panels are aligned with the gaskets 52 on the gasket lock flanges of such face members so that after the gaskets are removed, the connector clips may be cut by a suitable tool, such as a saw, inserted between the panel and the face member.

I claim:

1. A wall structure assembly including: a pair of frame members each having an elongate body, a first pair of longitudinal parallel flanges extending outwardly therefrom on a face of said body centrally of said face and a second pair of longitudinal parallel flanges extending outwardly therefrom on said face at the edges thereof; and a generally T-shaped joint clip for connecting one end of one of said members to the other of said members intermediate its ends to join said members in perpendicular relationship, said joint clip including a head portion connectible to said flange bearing face of said other of said members outwardly of said first pair of parallel flanges thereon and inwardly of one of said second pair of parallel flanges thereon; and a rib portion extending perpendicularly from said head portion and telescopical between the first pair of parallel flanges of said one of said members when said one end is positioned adjacent and perpendicular to said other of said members; and means for securing said rib portion to at least one of said flanges of said one of said members.

2. A wall system for use in a building wall comprising:

a panel having a thickness *t;* a first elongate member having a panel gripping side;

a panel gripping flange projecting from said side a distance *a;* a resilient gasket mounted on said flange and projecting therefrom a further distance *b;* a first pair of spaced parallel connecting flanges projecting from said side a distance *c*, said connecting flanges being spaced inwardly on said side from said panel gripping flange;

a second elongate member having a panel gripping side adapted for assembly in facing relationship with the panel gripping side of said first elongate member;

a second panel gripping flange on said second member projecting from its side a distance *d;* a resilient gasket mounted on said second flange and projecting therefrom a further distance *e;* a second pair of spaced parallel connecting flanges projecting from the side of said second member a distance *f*, said second connecting flanges being spaced inwardly on said side from said second panel gripping flange;

and a plurality of short longitudinally spaced unitary resilient plastic clips connected at their ends with said first and second pairs of connecting flanges, said clips having a length *g;* said members, their parts, gaskets and clips being so proportioned that the following relationships are true:

$c$ is substantially equal to or greater than $a + b + t$;

$c$ is less than $a + b + t + e$;

$f$ is no greater than $d$;

$f + c$ is less than $a + b + t + e + d$; and $g$ is no greater than $a + b + t + e + d$.

3. A wall system in accordance with claim 2, wherein cooperable lock means are provided on said connector clips and said connecting flanges, said cooperable lock means of said connector clips comprising a first pair and a second pair of transversely aligned longitudinal lock flanges extending in opposite directions from opposite sides of said connector clips, each lock flange having an outwardly inclined cam shoulder and a stop shoulder extending perpendicularly from said connector clips, said cooperable lock means of said connecting flanges comprising longitudinal grooves in which said lock flanges are receivable, said grooves having stop shoulders extending perpendicularly transversely of said connecting flanges and engageable by said lock flange stop shoulders, and wherein said connector clips are formed of a resilient insulating plastic whereby said connector clips may deform resiliently as said connector clip end portions telescope into said connecting flanges until said lock flanges move into alignment with said lock grooves and move into said grooves.

4. The wall system of claim 2, and further comprising a pair of longitudinal oppositely opening lock grooves adjacent the outer end of each panel gripping flange, and each of said gaskets having facing rear mount flanges receivable in said lock grooves of a panel gripping flange, said gaskets increasing in width from said mount flanges whereby when said gasket is placed under compression, said mount flanges are compressed into said lock grooves.

5. The system of claim 3, wherein said connector clips each have a slot therethrough to facilitate deformation thereof during telescoping of its end portions into said lock recesses.

* * * * *